US012365527B2

(12) United States Patent
Zamora et al.

(10) Patent No.: US 12,365,527 B2
(45) Date of Patent: Jul. 22, 2025

(54) VALVING SYSTEM AND VACUUM CONTAINERS

(71) Applicant: GENICOOK PRODUCT LLC, Garland, TX (US)

(72) Inventors: Marc Salvador Zamora, Barcelona (ES); David De Sicart Prieto, Barcelona (ES)

( * ) Notice: Subject to any disclaimer, the term of this patent is extended or adjusted under 35 U.S.C. 154(b) by 103 days.

(21) Appl. No.: 18/362,788

(22) Filed: Jul. 31, 2023

(65) Prior Publication Data

US 2025/0042639 A1 Feb. 6, 2025

(51) Int. Cl.

*B65D 81/20* (2006.01)
*B65D 33/01* (2006.01)
*B65D 77/22* (2006.01)

(52) U.S. Cl.

CPC ..... *B65D 81/2038* (2013.01); *B65D 33/01* (2013.01); *B65D 77/225* (2013.01); *B65D 81/2023* (2013.01)

(58) Field of Classification Search

CPC ..... B65D 81/2038; B65D 81/2023; B65D 77/225; B65D 33/01

See application file for complete search history.

(56) References Cited

U.S. PATENT DOCUMENTS 4,941,310 A * 7/1990 Kristen ..... B65B 31/046 53/434
5,009,828 A 4/1991 McCree
5,070,584 A 12/1991 Dais
5,332,095 A * 7/1994 Wu ..... B65D 77/225 137/859
5,450,963 A * 9/1995 Carson ..... B65D 81/2038 206/524.8
5,584,409 A * 12/1996 Chemberlen ..... B65D 77/225 220/373
6,070,728 A * 6/2000 Overby ..... B65D 81/2023 137/526
6,408,872 B1 * 6/2002 Skeens ..... F16K 15/148 137/550
6,604,634 B2 * 8/2003 Su ..... B65D 81/2038 206/524.8

(Continued)

FOREIGN PATENT DOCUMENTS

DE 202020002583 U1 * 12/2020
EP 0494559 A1 * 7/1992

(Continued)

*Primary Examiner* — David Colon-Morales
(74) *Attorney, Agent, or Firm* — Johnfar Julián Kerlee

(57) ABSTRACT

Disclosed are systems and methods related to a valving system that can be used with containers. In some embodiments, a valving system for a bag can include an air sieve coupled to a retaining cap. A sealing part is placed between the retaining cap and the air sieve. The retaining cap can include a passage for allowing air to flow out of the bag under the action of a vacuum pump. The sealing part can include a perforation configured to allow air flow from a channel of the air sieve. A sidewall of the bag is configured with an orifice to receive part of the air sieve, and the sidewall is compressed between the retaining cap and the air sieve. When the vacuum pump is removed, atmospheric pressure pushes against the sealing part, which then seals the bag by pushing against a sealing part seat of the air sieve.

16 Claims, 5 Drawing Sheets

(56) References Cited

U.S. PATENT DOCUMENTS 7,350,541 B2 * 4/2008 Kobetsky ..... B65D 81/2038 206/524.8
7,398,953 B2 * 7/2008 Anderson ..... B65D 81/2038 383/66
7,475,864 B2 * 1/2009 Tanaka ..... F16K 15/141 206/524.8
7,490,623 B2 * 2/2009 Rypstra ..... B65D 77/225 137/859
7,513,481 B2 * 4/2009 Su ..... B65D 31/14 206/524.8
7,578,320 B2 * 8/2009 Borchardt ..... B65D 81/2038 141/10
7,614,203 B2 * 11/2009 Oltrogge ..... B65B 31/047 53/139.2
7,972,064 B2 * 7/2011 Anderson ..... B65D 81/2023 383/105
8,016,261 B2 * 9/2011 Tang ..... B65D 77/225 206/524.8
8,066,433 B2 * 11/2011 Sabounjian ..... B65D 77/225 137/854
8,328,159 B2 * 12/2012 Lee ..... F16K 3/243 383/44
9,296,541 B2 * 3/2016 Turvey ..... F16K 7/17
10,266,330 B2 * 4/2019 Tanaka ..... B65D 81/2023
10,336,488 B1 * 7/2019 Kjelson ..... B65D 33/01
11,767,152 B2 * 9/2023 Morris, III ..... B65D 43/0231 220/240
11,890,583 B2 * 2/2024 Borjanin ..... B01F 23/23123
2004/0161178 A1 8/2004 Olechowski
2005/0244083 A1 * 11/2005 McMahon ..... B65D 81/2038 383/103
2006/0225787 A1 * 10/2006 Newrones ..... B65D 77/225 137/246
2006/0228057 A1 * 10/2006 Newrones ..... B65D 81/2023 383/103
2007/0241023 A1 * 10/2007 Ootsubo ..... B65D 81/2038 206/524.8
2008/0310770 A1 12/2008 Turvey
2012/0099806 A1 * 4/2012 Turvey ..... B65D 81/2023 383/44
2013/0228490 A1 * 9/2013 Park ..... B65D 77/225 206/524.8
2015/0183568 A1 7/2015 Wakabayashi
2019/0383408 A1 * 12/2019 Xu ..... B65D 81/2038
2020/0198868 A1 * 6/2020 Wang ..... F16K 15/144
2021/0362931 A1 11/2021 Lei
2022/0410086 A1 12/2022 Borjanin

FOREIGN PATENT DOCUMENTS

EP 3521203 A1 * 8/2019 ..... B65D 33/01
FR 2629060 A1 * 9/1989
KR 200339546 Y1 * 1/2004
KR 200356709 Y1 * 7/2004
KR 102742440 B1 * 12/2024
WO WO-2024091130 A1 * 5/2024

* cited by examiner

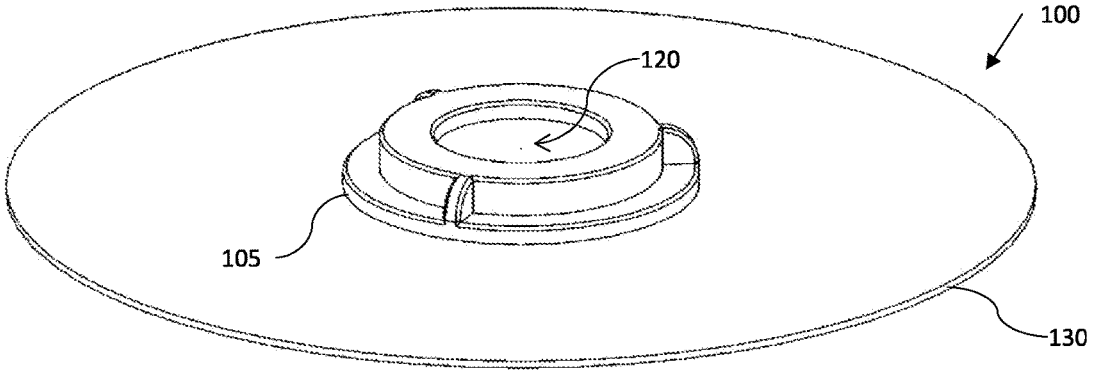
FIG. 1
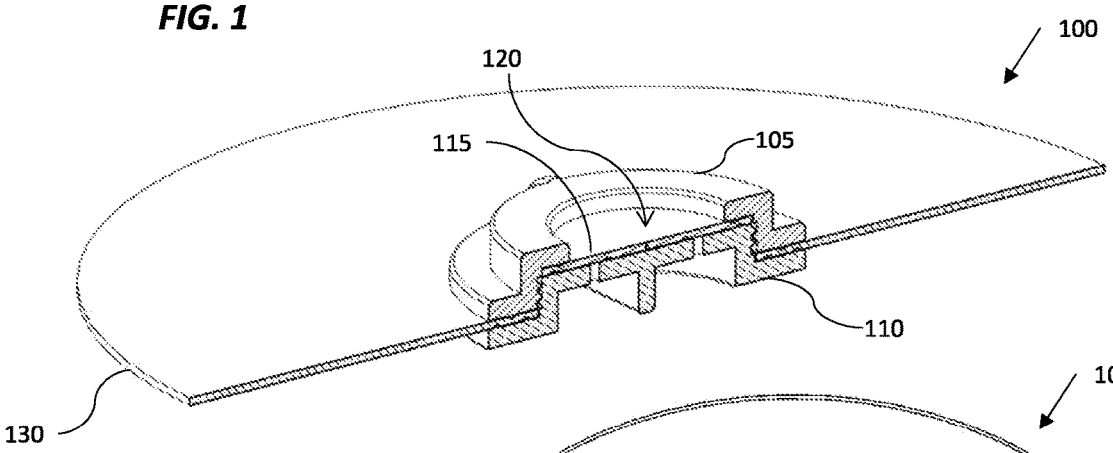
FIG. 2
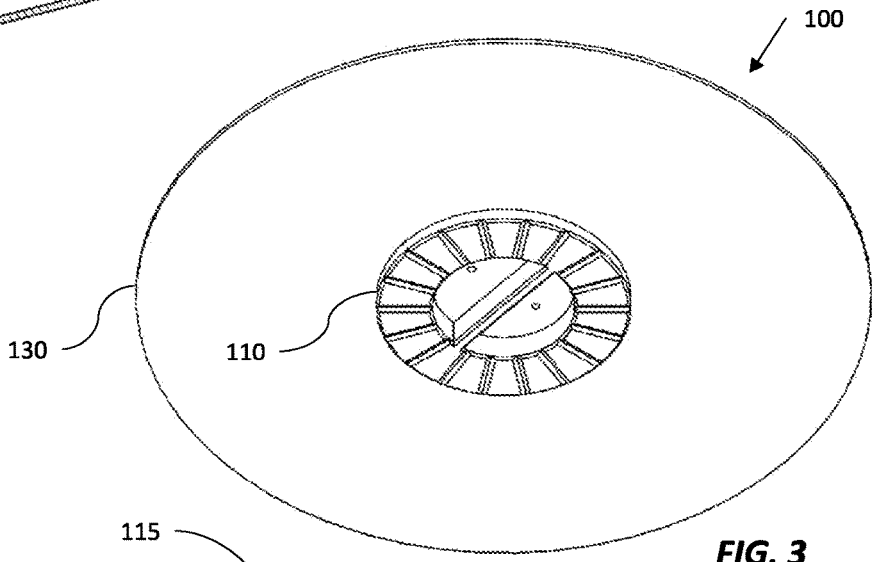
FIG. 3
FIG. 4
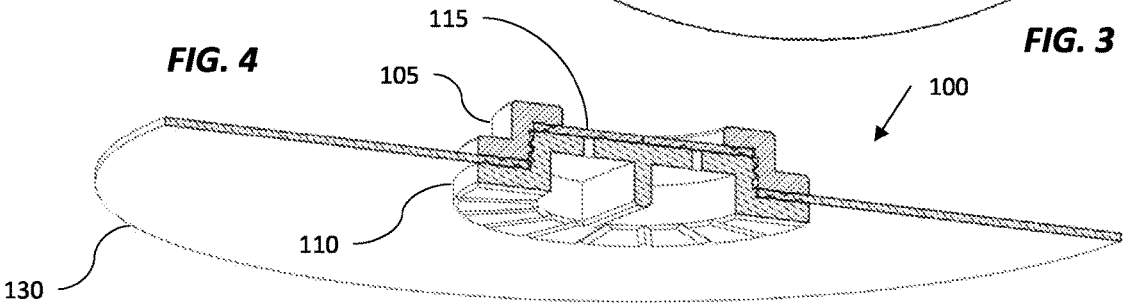

VALVING SYSTEM AND VACUUM CONTAINERS

BACKGROUND

Field

The inventive subject matter is generally directed towards systems and methods for fitting a container with a valve means to facilitate removing gas from the container with a vacuum device. In particular, embodiments of the invention relate to a storage container (such as a reusable, resealable food storage bag, for example) configured with a valve to facilitate removing air from inside the storage container.

Description of Related Art

Currently, food or other perishables are often stored in resealable containers such as resealable thermoplastic pouches. To keep food stored inside a pouch fresh for an extended period, a user may evacuate air out of the pouch before completely sealing a closure mechanism of the pouch. Other resealable pouches have been developed that have a valve that allows air to be evacuated from the pouch after the closure mechanism has already been sealed.

Some pouch valves have a patch of thermoplastic material covering an aperture in a pouch wall and sealed over a limited area of the pouch wall around a periphery of the patch. The patch has an aperture therethrough that is offset from the aperture in the pouch wall. Pressure from outside of the pouch forces the patch against the pouch wall keeping the valve closed. However, pressure from within the pouch forces the patch to separate from the pouch wall to allow air to flow through both apertures and out of the pouch.

Other valves have a cover flap disposed over an aperture in a pouch wall, wherein the cover flap lacks an aperture. The valves have an unsealed edge that provides a path for escaping air. One such valve has a separator layer disposed between an adhesive layer disposed on an inner surface of the cover flap and an aperture in the pouch wall. The separator layer is smaller than the cover flap, but larger than the aperture and is shaped so that the adhesive layer makes asymmetrical contact with the pouch wall around a periphery of the cover flap. Pressure from within the pouch forces a portion of the cover flap having a smaller adhesive contact area to separate from the pouch wall. The valve may also have an intermediate gas permeable layer between the separator layer and the aperture.

Another valve has a cover flap that is disposed across the entire width of a pouch wall. The flap overlays one or more apertures in the pouch wall to allow air to escape from within the pouch and prevent air from entering the pouch.

Yet another valve for a pouch has a patch that is disposed across an entire width of a pouch wall and is sealed to the pouch wall around a periphery of the patch. A first plurality of apertures extending through the pouch wall is offset from a second plurality of apertures extending through the patch. An adhesive is disposed between the first and second pluralities of apertures. Pressure from within the pouch overcomes the adhesive and forces the patch to separate from the pouch wall to allow air to escape from within the pouch.

Another valve has a patch that is sealed around the periphery of the valve over an inner or outer surface of a plastic tube. The patch may be oriented axially along the length of the tube, or circumferentially around the tube. The patch has a vent opening that is offset from a vent opening through the tube surface. A vent seal zone is defined between the patch and the tube surface. The tube is sealed on both ends such that pressure from within the tube forces the patch to separate from the tube surface to allow air to escape from within the tube.

Yet another valve has first and second zipper flanges sealed to an inside surface of a pouch wall. A line of apertures is disposed through the pouch wall, wherein the first zipper flange is attached to the pouch wall on a first side of the apertures and the second zipper flange is attached to the pouch wall on a second opposite side of the apertures. An air path is formed between the first and second zipper flanges and the apertures. Pressure from within the pouch forces the second flange away from the first flange and pressure from outside the pouch forces the second flange into contact with the first flange. Alternatively, the second flange is eliminated and the pouch wall on the second side of the line of apertures contacts the first flange. In another variation, one or more apertures disposed through the first flange are covered in flap fashion by the second flange.

Vacuum compression storage bags are known in the art. Such storage bags generally include a first side panel and a second side panel which side panels are sealed at the edges and the bottom forming the bag having an open top. These bags further include a re-closable closure mechanism near the top portion of the bag for opening and closing the bag. The bags further include a valve for release of air from the storage bag after the bag is filled with the material to be stored such as disclosed, for example, in U.S. Pat. No. 6,408,872. Air is removed from the bag by placing a pump over the valve to remove the air. One shortcoming of such large vacuum compression storage bags for clothing and other items is the need to use a rather large and complex injection molded valve. Such valves increase the cost of manufacture of the bag and the corresponding cost to the consumer. The complexity of the valve is often necessary to obtain the removal of substantially all the air in the bag. The valve will include rigid legs or protrusions to prevent the valve from contacting the adjacent side panel of the bag or the items, for example, clothing, stored in the bag to avoid inhibiting the air flow and removal of the air from the bag.

It is known that frozen foods are sometimes sold in plastic packages with built-in zipper strips for resealing. Some of them are vacuum sealed at the factory. When the seal is broken to allow removal and/or addition of food, the entry of air and moisture into the package frequently causes ice formation. The result is a deterioration of the food and a reduction in flavor and edibility. Also, the long-term storage viability of the food contained therein is reduced upon resealing. Various patents have been disclosed pertaining to closures and sealing systems for food packages, and they include U.S. Pat. Nos. 4,941,310; 5,009,828; 5,070,584; US 2003/0152296 A1; U.S. Pat. No. 6,692,147; B2; 2004/0114837 A1; 2004/0161178 A1; 2005/0196077 A1; 2005/0244083 A1; and 2007/0110340 A1.

What is needed in the art are systems and methods that simply and economically facilitate the use of a vacuum to remove gas/air from containers closed/sealed containers.

SUMMARY OF ILLUSTRATIVE EMBODIMENTS

Additional features and advantages of the embodiments disclosed herein will be set forth in the detailed description that follows, and in part will be clear to those skilled in the art from that description or recognized by practicing the embodiments described herein, including the detailed description which follows, the claims, as well as the appended drawings.

In one aspect the invention concerns a valving system for a container. In one embodiment, the valving system includes an air sieve; a sealing part placed on the air sieve, the sealing part having at least one perforation; a retaining cap configured to be coupled to the air sieve. In some embodiments the retaining cap has a central air passage configured to allow air flow when the valving system is coupled to a vacuum pump, the central air passage further configured to allow atmospheric pressure to be applied to the sealing part when the valving system is uncoupled from the vacuum pump. In certain embodiments, the sealing part is retained between the air sieve and the retaining cap.

In one embodiment, the air sieve comprises a sealing part seat configured to provide a surface that the sealing part pushes against when under atmospheric pressure. In some embodiments, the air sieve further includes: a plurality of radial grooves configured to allow air flow; a central air channel in fluid communication with the plurality of radial grooves to receive air from the plurality of radial grooves, the central air channel formed in a first side of the air sieve; and at least one air outlet configured to allow passage of air from the central air channel to a second side of the air sieve.

In some embodiments, the retaining cap has a cap threaded part, and the air sieve further includes a sieve threaded part configured to couple to the cap threaded part. In certain embodiments, the retaining cap further includes means for facilitating manual coupling and uncoupling of the retaining cap from the air sieve. In yet other embodiments, the central air channel has two compartments and two air outlets, with each compartment in fluid communication with a unique air outlet.

In one embodiment, the retaining cap is further configured to facilitate the use of a vacuum pump to evacuate air from the container. In some embodiments, the air sieve is configured to fit into a hole in a wall of the container, wherein first side of the air sieve is internal to the container and the second side of the air sieve is external to the container. In certain embodiments, the retaining cap comprises a cap threaded part; the air sieve further comprises a sieve threaded part configured to couple to the cap threaded part; and the sieve threaded part is formed at least partly on the second side of the air sieve.

In another aspect the invention is directed to a container with a vacuum valve. In some embodiments, the container can include a sidewall having an orifice; an air sieve configured to fit into the orifice and to allow passage of air from inside the container to outside the container; a sealing part configured to cooperate with the air sieve to allow flow of air from inside the container to outside the container, the sealing part further configured to push against the air sieve when the sealing part is under atmospheric pressure; and a retaining cap configured to be coupled to the air sieve, the retaining cap further configured to retain the sealing part between the retaining cap and the air sieve.

In one embodiment, the air sieve has a sealing part seat configured to provide a surface that the sealing part pushes against when under atmospheric pressure. In some embodiments, the air sieve further can include: a plurality of radial grooves configured to allow air flow; a central air channel in fluid communication with the plurality of radial grooves to receive air from the plurality of radial grooves, the central air channel formed in a first side of the air sieve; and at least one air outlet configured to allow passage of air from the central air channel to a second side of the air sieve.

In certain embodiments, retaining cap can include a cap threaded part, and the air sieve further includes a sieve threaded part configured to couple to the cap threaded part. In one embodiment, the retaining cap further can include means for facilitating manual coupling and uncoupling of the retaining cap from the air sieve. In yet other embodiments, the central air channel has two compartments and two air outlets, with each compartment in fluid communication with a unique air outlet. In some embodiments, the retaining cap can be further configured to facilitate the use of a vacuum pump to evacuate air from the container.

In one embodiment, the first side of the air sieve is internal to the container and the second side of the air sieve is external to the container. In certain embodiments, the retaining cap can include a cap threaded part; the air sieve can include a sieve threaded part configured to couple to the cap threaded part; and the sieve threaded part is formed at least partly on the second side of the air sieve. In yet other embodiments, at least part of the sidewall is compressed between the retaining cap and the air sieve. In certain embodiments, the container is a silicone bag for storing food.

Both the foregoing general description and the following detailed description present embodiments intended to provide an overview or framework for understanding the nature and character of the embodiments disclosed herein. The accompanying drawings are included to provide further understanding and are incorporated into and constitute a part of this specification. The drawings illustrate various embodiments of the disclosure, and together with the description explain the principles and operations thereof.

BRIEF DESCRIPTION OF THE DRAWINGS

A more complete understanding of the embodiments, and the attendant advantages and features thereof, will be more readily understood by references to the following detailed description when considered in conjunction with the accompanying drawings wherein:

FIG. 1 is a top perspective view of a valving system according to one embodiment of the invention.

FIG. 2 is a cross-sectional perspective view of the valving system of FIG. 1.

FIG. 3 is a bottom perspective view of the valving system of FIG. 1.

FIG. 4 is another cross-sectional perspective view of the valving system of FIG. 1.

DETAILED DESCRIPTION OF ILLUSTRATIVE EMBODIMENTS

Figure 5:
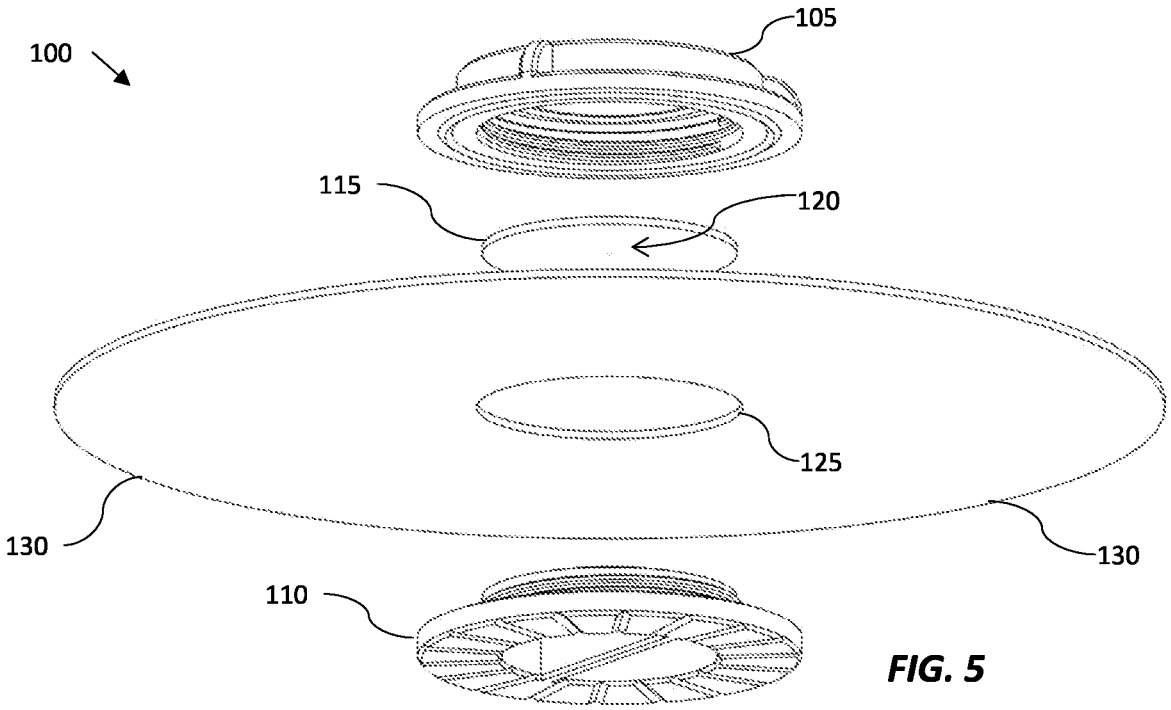
FIG. 5 is an exploded perspective view of the valving system of FIG. 1.
Figure 6:
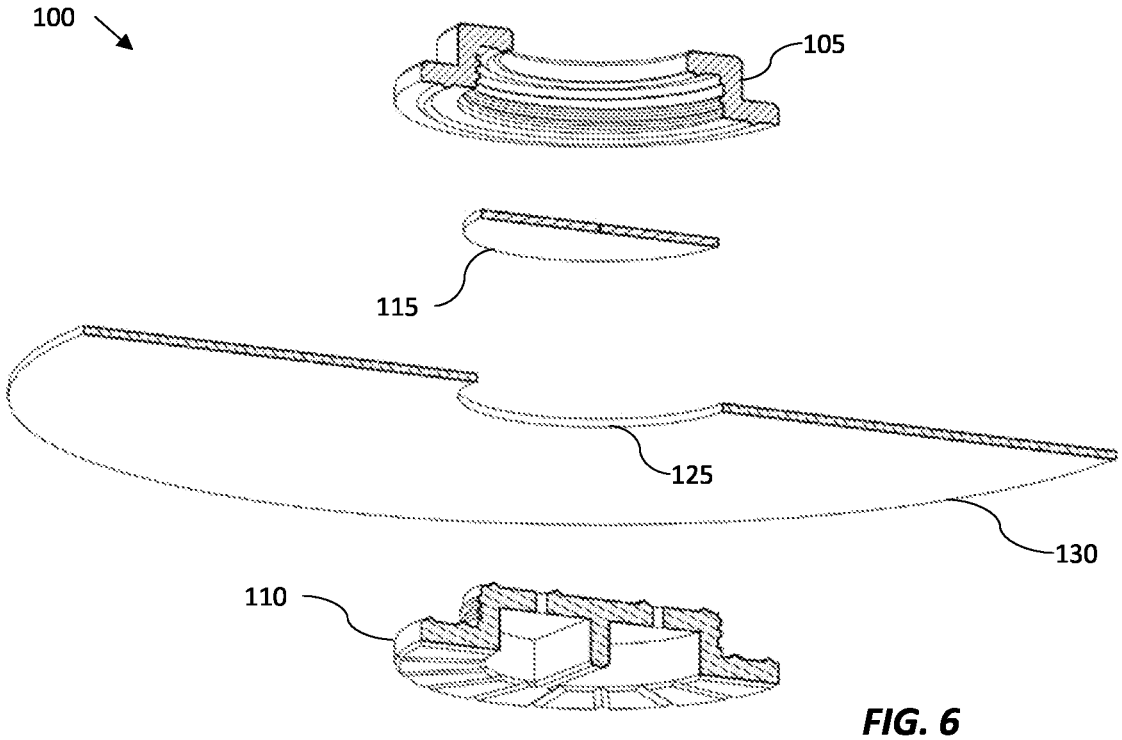
FIG. 6 is a cross-sectional exploded perspective view of the valving system of FIG. 1.

The specific details of the single embodiment or variety of embodiments described herein are set forth in this application. Any specific details of the embodiments are used for demonstration purposes only, and no unnecessary limitation or inferences are to be understood therefrom.

Before describing in detail exemplary embodiments, it is noted that the embodiments reside primarily in combinations of components related to the system. Accordingly, the device components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

Referencing FIG. 1-6, in one embodiment, valving system 100 can include retaining cap 105 configured to be removably coupled to air sieve 110. As used here, air sieve refers to a valve body configured to guide/allow the flow of air from an internal space to an external space. In some embodiments, valving system 100 can include sealing part 115 that is placed against air sieve 110 and retained between retaining cap 105 and air sieve 110. Sealing part 115 includes at least one perforation 120, which perforation 120 is configured to allow passage of air from inside a container (not shown) to outside the container. In some embodiments, air sieve 110 is configured to fit into sidewall orifice 125 of sidewall 130, which sidewall 130 can be a sidewall of, for example, a flexible container (such as a plastic or silicone bag for storing food).

Figure 7:
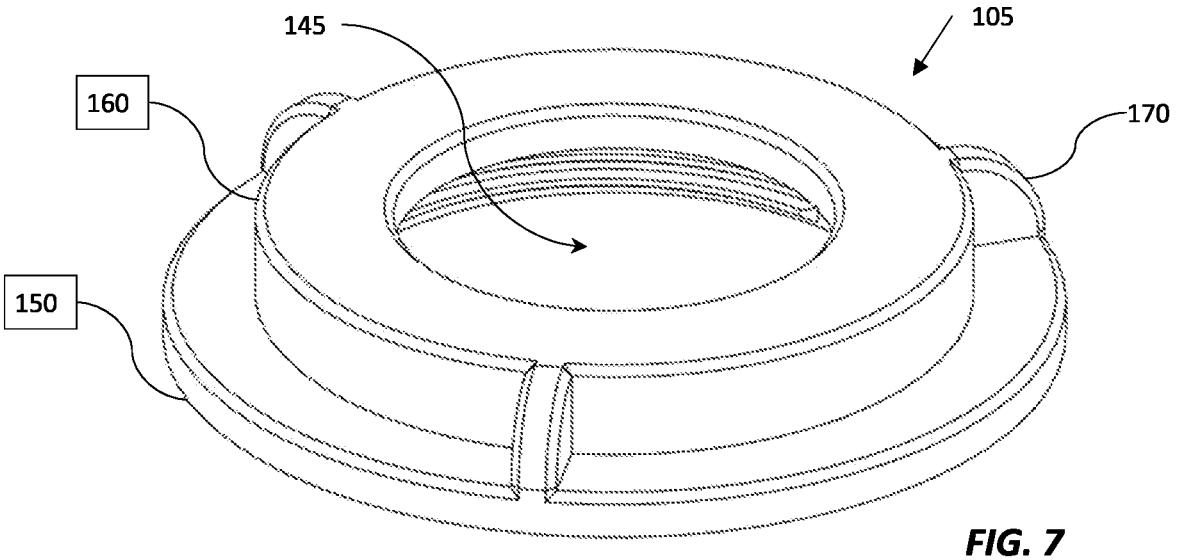
FIG. 7 is a top perspective view of a certain component of the valving system of FIG. 1.
Figure 8:
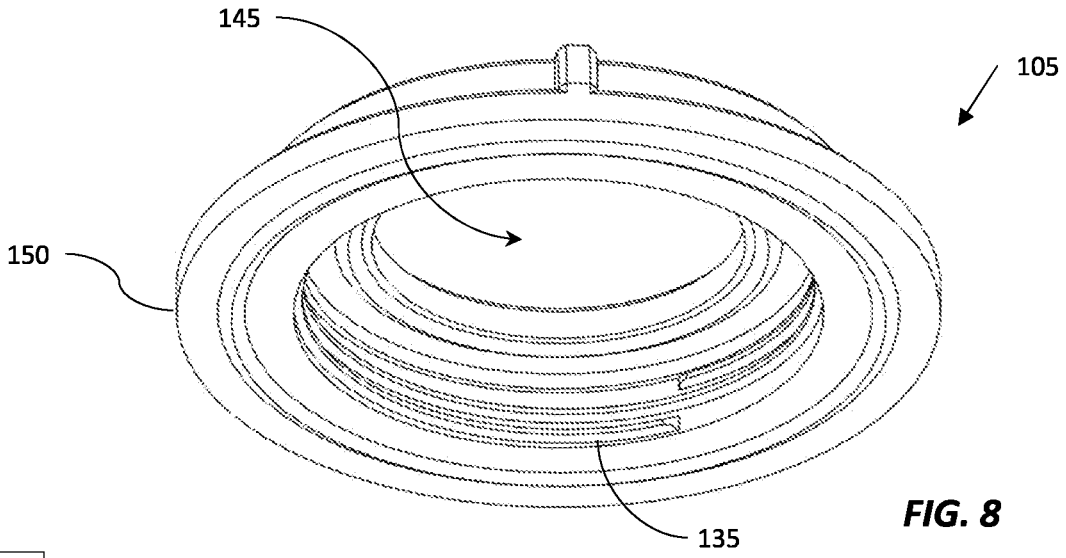
FIG. 8 is a bottom perspective view of the component of FIG. 7.
Figure 9:
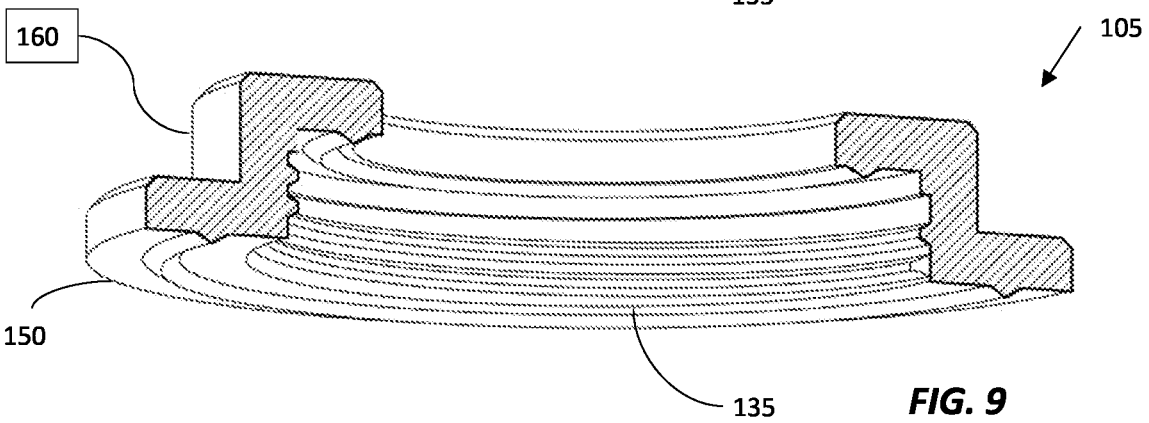
FIG. 9 is a cross-sectional perspective view of the component of FIG. 7.
Figure 14:
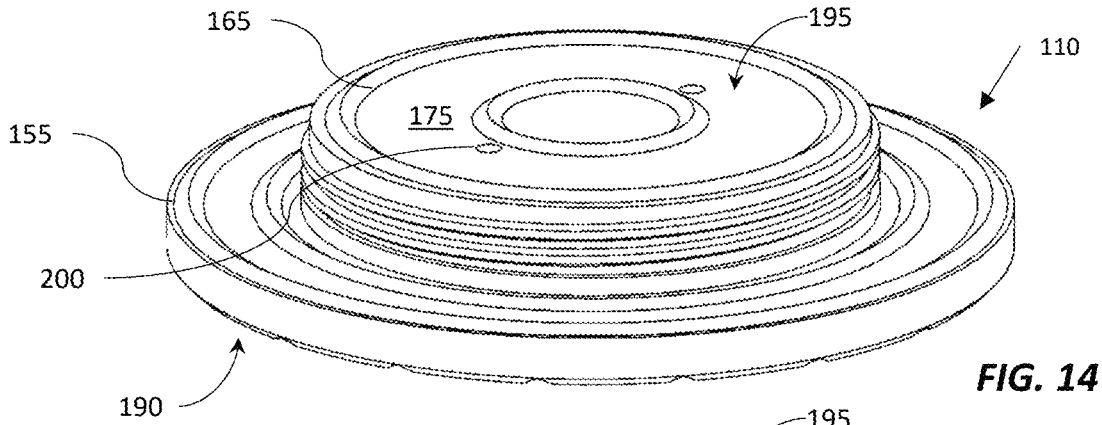
FIG. 14 is a top perspective view of one more component of the valving system of FIG. 1.

Referencing FIG. 7-9, in one embodiment, retaining cap 105 can include retaining cap threaded part 135 configured to thread to matching sieve threaded part 140 (FIG. 14). In some embodiments, retaining cap 105 can include retaining cap central passage 145 configured to allow air flow from inside the container when valving system 100 is acted upon by a vacuum pump coupled to retaining cap 105. In certain embodiments, retaining cap 105 can include first retaining cap flange 150 configured to cooperate with air sieve first retaining flange 155 to compress sidewall 130 between first retaining cap flange 150 and air sieve first retaining flange 155. In one embodiment, retaining cap 105 can include second retaining cap flange 160 configured to cooperate with air sieve second retaining flange 165 to retain sealing part 115 between second retaining cap flange 160 and air sieve second retaining flange 165. In some embodiments, retaining cap 105 can include grip tabs 170 configured to facilitate the manual turning of retaining cap 105 to couple and uncouple retaining cap 105 from air sieve 110. While the illustrated embodiment shows retaining cap 105 configured to couple to air sieve 110 through cap threaded part 135 and sieve threaded part 140, in other embodiments retaining cap 105 can be rigidly coupled to air sieve 110 by, for example, an ultrasonic weld.

Figure 10:
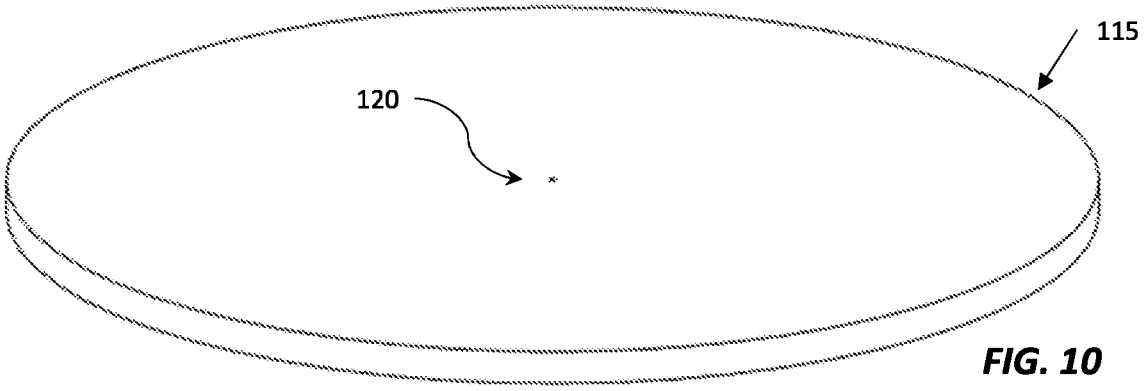
FIG. 10 is a top perspective view of another component of the valving system of FIG. 1.
Figure 11:
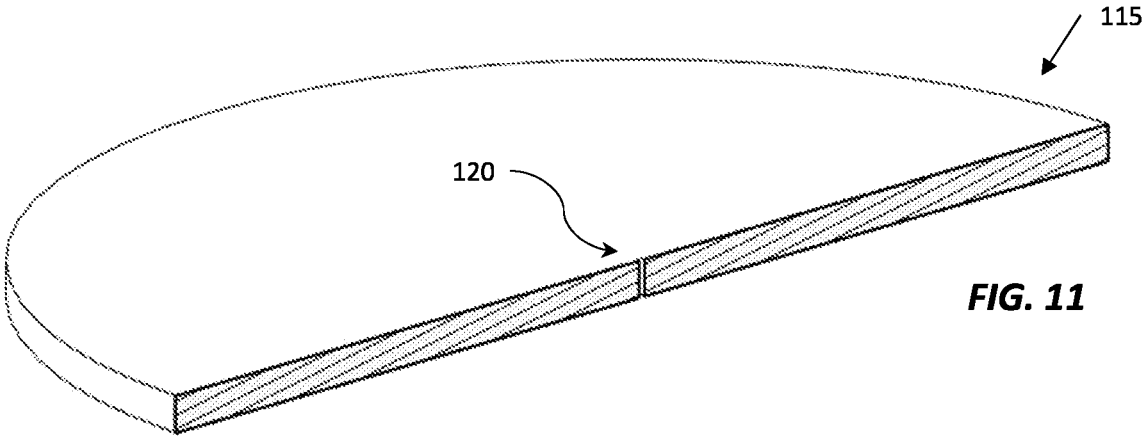
FIG. 11 is a cross-sectional perspective view of the component of FIG. 10.

Referencing FIG. 10-11, in some embodiments, sealing part 115 can be, for example, a disc having perforation 120. Sealing part 115 can be made of the same material as sidewall 130. Preferably perforation 120 is configured with a small diameter suitable to allow air to flow therethrough under action of a vacuum pump on sealing part 115; however, under atmospheric pressure when the vacuum pump is removed, sealing part 115 is pushed by atmospheric pressure against sealing part seat 175 of air sieve 110, and perforation 120 in such state substantially does not allow flow of external air into the container. In certain embodiments, sealing part 115 is configured with a thickness substantially the same as the thickness of sidewall 130.

Figure 12:
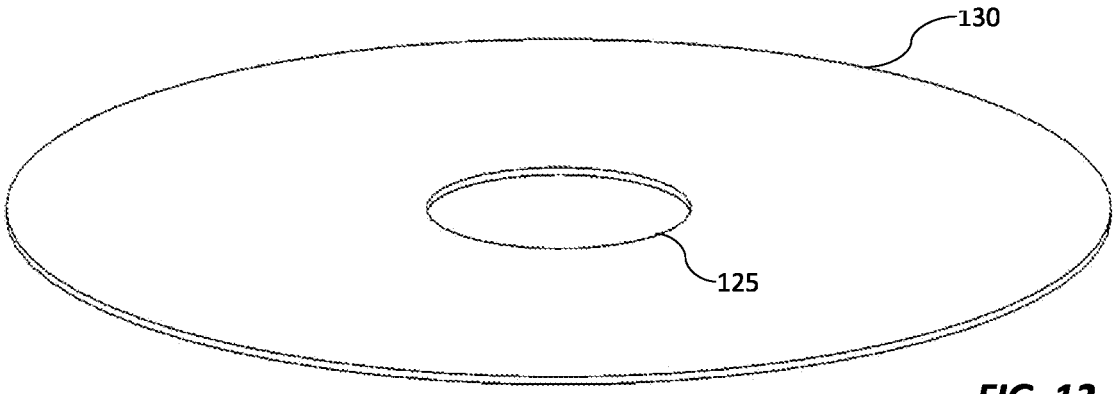
FIG. 12 is a top perspective view of yet another component of the valving system of FIG. 1.
Figure 13:
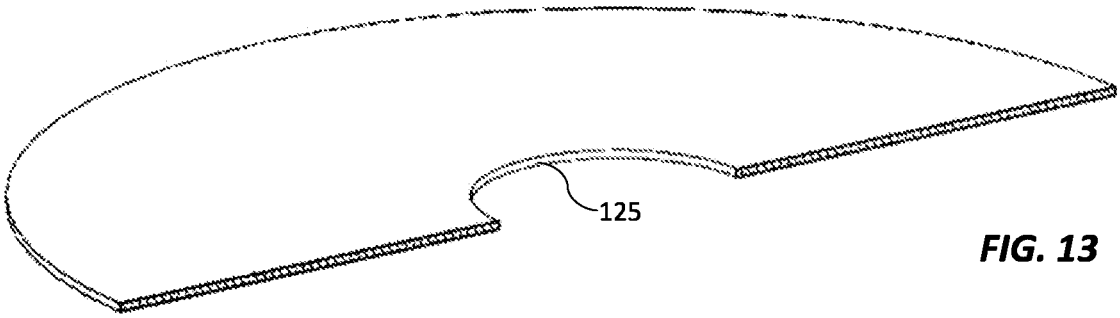
FIG. 13 is a cross-sectional perspective view of the component of FIG. 12.

Referencing FIG. 12-13, in some embodiments, sidewall 130 can be one of several walls that conform a container (not shown in its entirety). Such a container can be, for example, a flexible or semiflexible bag or box. In one embodiment, sidewall 130 is a sidewall of a plastic or silicone bag used for storing items such as food. In certain embodiments, sidewall 130 is a sidewall of a bag configured to be reusable or resealable with, for example, a zip lock mechanism.

Referencing FIG. 14-17, in some embodiments, air sieve 110 can include sealing part seat 175 configured to provide a surface for sealing part 115 to push against when sealing part 115 is acted upon by atmospheric pressure. Sealing part seat 175 can also act as air sieve second retaining flange 165, which in cooperation with second retaining cap flange 160 acts to retain at least part of sealing part 115 (as illustrated, for example, in FIG. 2 and FIG. 4).

Figure 15:
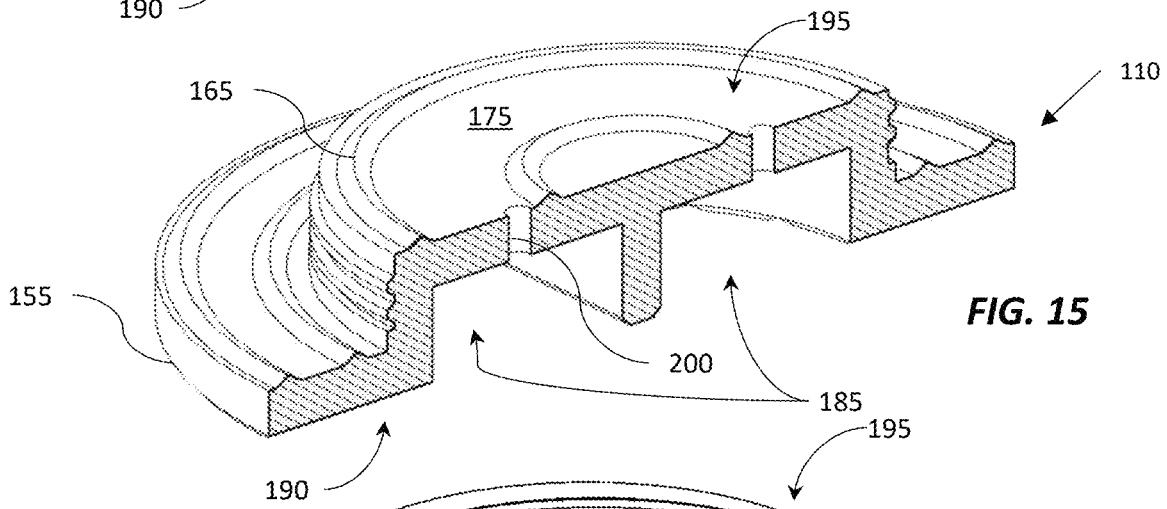
FIG. 15 is a cross-sectional top perspective view of the component of FIG. 14.
Figure 16:
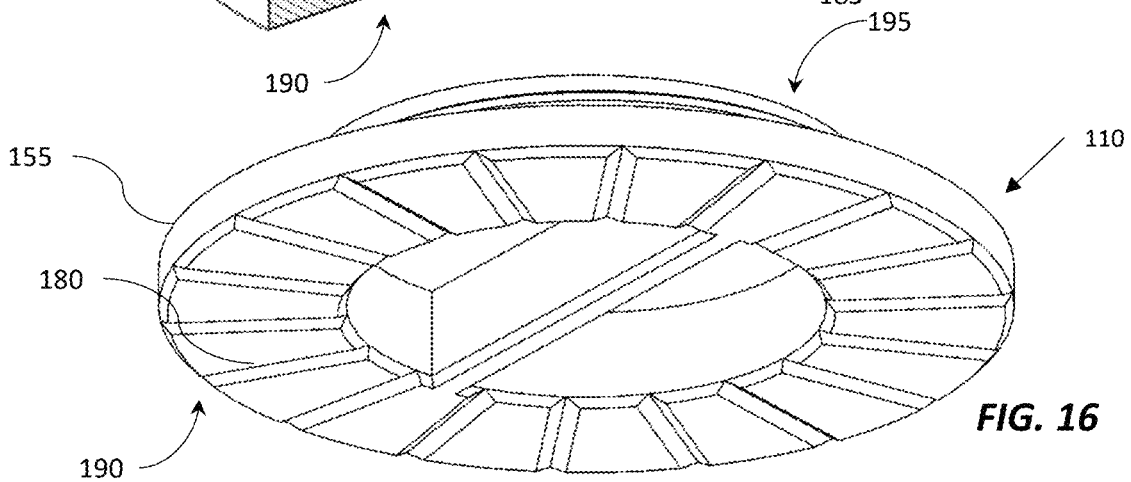
FIG. 16 is a bottom perspective view of the component of FIG. 14.
Figure 17:
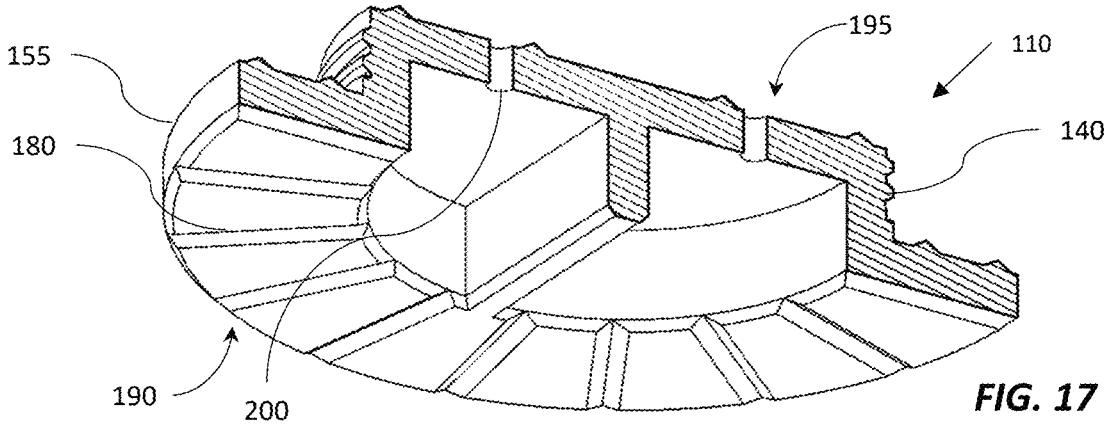
FIG. 17 is a cross-sectional bottom perspective view of the component of FIG. 14.

In certain embodiments, air sieve 110 can include radial grooves 180 running along a side of air sieve first retaining flange 155. Radial grooves 180 are preferably configured to facilitate air flow from the inside of the container to air sieve central air channel 185. In one embodiment, air sieve 110 can be made as a single piece having sieve internal side 190 and sieve external side 195. Radial groove 180 and air sieve central air channel 185 can be formed on sieve internal side 190. Sieve threaded part 140, air sieve second retaining flange, and sealing part seat 175 can be formed on sieve external side 195. In some embodiments, air sieve 110 can include one or more air outlets 200 configured to allow passage of air from air sieve central air channel 185 to a space created between sealing part 115 and sealing part seat 175 when a vacuum pump acts upon valving system 100. In certain embodiments, as illustrated in FIG. 15-17, air sieve central air channel 185 can include multiple compartments, with each compartment allowing air flow to a respective air outlet 200.

In one embodiment, a vacuum bag (not shown) can be made by providing a bag having multiple sidewalls. One of the walls can be sidewall 130 having sidewall orifice 125. Air sieve 110 can be inserted through orifice 125 so that sieve internal side 190 is placed in the internal space of the vacuum bag and sieve external side 195 is placed in the space external to the vacuum bag. Sealing part 115 is placed on sealing part seat 175. Retaining cap 105 is coupled to air sieve 110 by, for example, threading retaining cap 105 onto air sieve 110.

During use of the vacuum bag, the vacuum bag can be closed or sealed with, for example, a resealable fastener such as a zip lock. It is then desired to store the items in the bag under vacuum by evacuating air from the vacuum bag. A vacuum pump is coupled to retaining cap 105 and activated. Under action of the vacuum pump, air flows through radial grooves 180 to air sieve central air channel 185, then through air outlets 200, and to the outside of the vacuum bag through perforation 120. As air is evacuated from the vacuum bag, atmospheric pressure starts to apply a negative pressure against the walls of the vacuum bag. When the vacuum pump is removed, the atmospheric pressure pushes sealing part 115 against sealing part seat 175, which prevents any external air from entering the vacuum bag through perforation 120.

When desired, retaining cap 105 can be uncoupled from air sieve 110 to, for example, clean valving system 100. Sealing part 115 is also removable, disposable, and replaceable independently of the other components of valving system 100. If a vacuum bag is damaged, or becomes too old, or acquires a bad smell, valving system 100 can be removed from the vacuum bag and used with another bag having a sidewall orifice adapted to receive valving system 100.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

It will be appreciated by persons skilled in the art that the present embodiment is not limited to what has been particularly shown and described hereinabove. A variety of modifications and variations are possible considering the above teachings without departing from the following claims.

The invention claimed is:

1. A valving system for a container, the valving system comprising:

an air sieve;

a sealing part placed on the air sieve, the sealing part having at least one movable perforation;

a retaining cap configured to be coupled to the air sieve;

wherein the retaining cap comprises a central air passage configured to allow air flow from outside the container to the sealing part, the central air passage further configured to allow air flow from the sealing part to outside the container during evacuation of air from the container;

wherein the sealing part is retained between the air sieve and the retaining cap;

wherein the movable perforation is configured such that:

(a) under atmospheric pressure, the movable perforation is pressed against the air sieve to prevent air flow through the movable perforation, and (b) under vacuum, the movable perforation is displaced away from the air sieve, allowing air flow through the movable perforation.

2. The valving system of claim 1, wherein the air sieve comprises a sealing part seat configured to provide a surface that the sealing part pushes against when under atmospheric pressure.

3. The valving system of claim 2, wherein the air sieve further comprises:

a plurality of radial grooves configured to allow air flow;

a central air channel in fluid communication with the plurality of radial grooves to receive air from the plurality of radial grooves, the central air channel formed in a first side of the air sieve; and at least one air outlet configured to allow passage of air from the central air channel to a second side of the air sieve.

4. The valving system of claim 3, wherein the retaining cap comprises a cap threaded part, and wherein the air sieve further comprises a sieve threaded part configured to couple to the cap threaded part.

5. The valving system of claim 4, wherein the retaining cap further comprises means for facilitating manual coupling and uncoupling of the retaining cap from the air sieve.

6. The valving system of claim 3, wherein the air sieve is configured to fit into a hole in a wall of the container, wherein first side of the air sieve is internal to the container and the second side of the air sieve is external to the container.

7. The valving system of claim 6, wherein:

the retaining cap comprises a cap threaded part;

the air sieve further comprises a sieve threaded part configured to couple to the cap threaded part; and the sieve threaded part is formed at least partly on the second side of the air sieve.

8. A valving system for a container, the valving system comprising:

an air sieve;

a sealing part placed on the air sieve, the sealing part having at least one perforation;

a retaining cap configured to be coupled to the air sieve;

wherein the retaining cap comprises a central air passage configured to allow air flow from outside the container to the sealing part, the central air passage further configured to allow air flow from the sealing part to outside the container during evacuation of air from the container;

wherein the sealing part is retained between the air sieve and the retaining cap;

wherein the air sieve comprises:

a sealing part seat configured to provide a surface that the sealing part pushes against when under atmospheric pressure;

a plurality of radial grooves configured to allow air flow;

a central air channel in fluid communication with the plurality of radial grooves to receive air from the plurality of radial grooves, the central air channel formed in a first side of the air sieve; and wherein the central air channel comprises a first compartment, a first air outlet, a second compartment, and a second air outlet, with the first compartment in fluid communication with the first air outlet and the second compartment in fluid communication with the second air outlet.

9. A container with a vacuum valve, the container comprising:

a sidewall having an orifice;

an air sieve configured to fit into the orifice and to allow passage of air from inside the container to outside the container;

wherein the air sieve comprises:

a plurality of radial grooves configured to allow air flow;

a central air channel in fluid communication with the plurality of radial grooves to receive air from the plurality of radial grooves, the central air channel formed in a first side of the air sieve;

wherein the central air channel comprises (i) a first compartment having a first air outlet and (ii) a second compartment having a second air outlet;

a sealing part configured to cooperate with the air sieve to allow flow of air from inside the container to outside the container, the sealing part further configured to push against the air sieve when the sealing part is under atmospheric pressure; and a retaining cap configured to be coupled to the air sieve, the retaining cap further configured to retain the sealing part between the retaining cap and the air sieve.

10. The container of claim 9, wherein the air sieve comprises a sealing part seat configured to provide a surface that the sealing part pushes against when under atmospheric pressure.

11. The container of claim 10, wherein the retaining cap comprises a cap threaded part, and wherein the air sieve further comprises a sieve threaded part configured to couple to the cap threaded part.

12. The container of claim 11, wherein the retaining cap further comprises means for facilitating manual coupling and uncoupling of the retaining cap from the air sieve.

13. The container of claim 9, wherein the first side of the air sieve is internal to the container and the second side of the air sieve is external to the container.

14. The container of claim 13, wherein:

the retaining cap comprises a cap threaded part;

the air sieve further comprises a sieve threaded part configured to couple to the cap threaded part; and the sieve threaded part is formed at least partly on the second side of the air sieve.

15. The container of claim 14, wherein at least part of the sidewall is compressed between the retaining cap and the air sieve.

16. The container of claim 15, wherein the container is a silicone bag for storing food.

* * * * *